United States Patent [19]

Laumont

[11] Patent Number: 4,527,966

[45] Date of Patent: Jul. 9, 1985

[54] APPARATUS FOR AN HYDROSTATIC COMPENSATION OF HYDRAULIC PUMPS AND MOTORS OF GEAR TYPE

[75] Inventor: Roger Laumont, La Varenne St. Hilaire, France

[73] Assignee: Hydroperfect International Hpi, Chennevieres, France

[21] Appl. No.: 591,796

[22] Filed: Mar. 21, 1984

[30] Foreign Application Priority Data

Mar. 22, 1983 [FR] France ..... 83 04650

[51] Int. Cl.[3] ..... F04C 15/00; F04C 2/14

[52] U.S. Cl. ..... 418/132

[58] Field of Search ..... 418/132, 131, 149

[56] References Cited

U.S. PATENT DOCUMENTS 3,096,719 7/1963 McAlvay ..... 418/132
3,291,053 12/1966 Gordon ..... 418/132
3,482,524 12/1969 Marietta ..... 418/132
4,358,260 11/1982 Joyner ..... 418/132

*Primary Examiner*—Richard E. Gluck
*Attorney, Agent, or Firm*—Browdy and Neimark

[57] ABSTRACT

An apparatus for an hydrostatic compensation of hydraulic pumps and motors of gear type in which two intermeshing gears are mounted on shafts which are supported by bearings or journal-bearings which can slide within the cavity of a pump or a motor housing closed on both lateral sides by covers. Compensation chambers between the bearings and the covers are delimited by grooves respectively provided in the faces facing bearings and covers. A part of one side of the grooves provided in the bearings is in alignment with one of the grooves provided in the corresponding cover. Deformable tightness seals are arranged in said grooves.

5 Claims, 6 Drawing Figures

APPARATUS FOR AN HYDROSTATIC COMPENSATION OF HYDRAULIC PUMPS AND MOTORS OF GEAR TYPE

FIELD OF THE INVENTION

The present invention relates to gear pumps or motors whose gears supported by shafts are disposed between two bearings which are pressure-loaded against the side-faces of the gears.

BACKGROUND OF THE INVENTION

In the prior art many means have been proposed to apply, on the bearings, forces known as compensation forces, and more often the prior art provides the confinement of the compensation chambers between the bearings and the covers closing the pump or motor housing on its lateral sides.

In some publications, for example in U.S. Pat. No. 3,473,476, compensation chambers are delimited by walls engaging in grooves, the walls being somewhat used as sealing means between the bearings and the covers. The same has been proposed in French Pat. No. 1,598,392 which shows seals disposed in grooves of the pump or motor housing, these seals delimiting complex-shaped chambers in which some fluid is pressure-loaded with a pressure corresponding to that which operates on the opposite face of the bearing, that is to say the face directed towards the gears.

Other publications show other similar seals and chambers. It is the case, in particular, of U.S. Pat. Nos. 3,482,524 and 3,142,260.

Applicant has shown, particularly in French Pat. No. 73 02257 published under No. 2,215,103, a similar arrangement in which a seal is provided either in the bearings, or in the cover in order to delimit compensation chambers.

The foregoing arrangements are generally satisfactory but have proved to be imperfect for hydraulic pumps or motors working under very high pressure. Actually, the seals as well as the walls for maintaining the seals are generally fragile members. Moreover, when provided, walls limit the surface on which the compensation pressure can operate.

The present invention resolves this problem by enabling the exertion of compensation pressures on the whole useful surface of the bearings of a pump or a motor, and in this whatever the rotary direction of the gears.

SUMMARY OF THE INVENTION

According to the invention, there is provided an apparatus for the hydrostatic compensation of hydraulic pumps or motors of gear type. The apparatus, which includes two intermeshing gears mounted on shafts supported by bearings or journal-bearings which can slide within the cavity of a pump or a motor housing closed on its lateral sides by end covers and compensation chambers provided between the bearings and the covers, is characterized by the chambers being delimited by grooves respectively located in the faces facing the bearings and the covers, a part of one side of the grooves provided in the bearings being aligned with one side of the grooves provided in the corresponding cover, and deformable tightness seals being disposed in the grooves.

Various other features of the present invention will become apparent from the following detailed description.

BRIEF DESCRIPTION OF THE DRAWINGS

An embodiment of the present invention is shown as merely illustrative but not limiting in itself, with reference to the accompanying drawings, wherein.

DETAILED DESCRIPTION OF THE INVENTION

Figure 1:
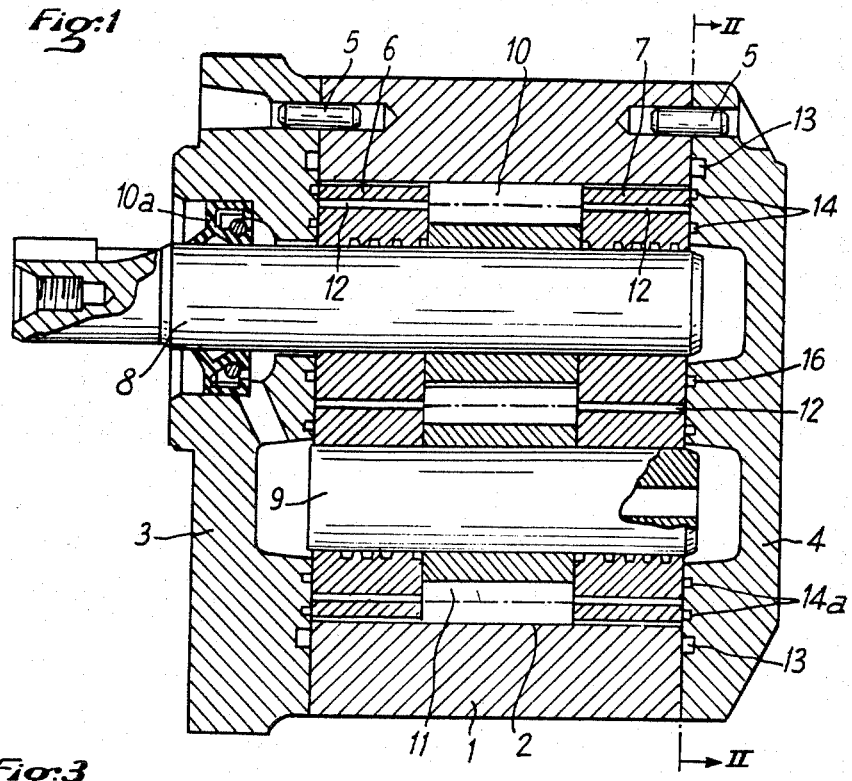
FIG. 1 is a cross-sectional view of a hydraulic gear pump or motor of a type in accordance with the present invention.
Figure 3:
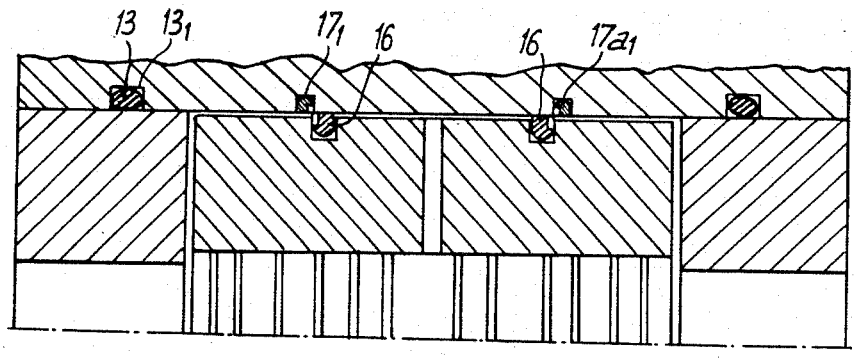
FIG. 3 is a partial cross sectional view, partially diagrammatic and substantially taken along line III—III of FIG. 2.

The following description refers to a hydraulic gear pump constructed so as to function in both possible rotary directions. The following description can also apply in the same way to a hydraulic motor and, where applicable, to a hydraulic pump or motor intended to function in only one rotary direction. The only difference between the pump described herein and a motor is in the configuration that the chambers, or so called compensation areas, may present such formation of the chambers or compensation areas, which are specific to a motor or a pump of only one possible rotary direction, are described in various documents.

The pump of the present invention comprises a housing 1 delimiting a cavity 2 of an ovoid configuration.

The housing 1 is closed on each of its two sides by end-covers 3, 4 which are connected to the housing 1 by centering-pieces 5. The cavity 2 contains bearings or journal-bearings 6, 7 which can slide by slight friction in the cavity 2. The bearings 6, 7 support longitudinal shafts 8 and 9 on which gears 10 and 11 are secured.

In the described pump, the shaft 8 constitutes the driving-shaft and protrudes from the cover 3 whereas the shaft 9 is completely housed within the pump. A tightness seal 10*a* is provided on the shaft 8 to avoid any possible leakage of the working fluid contained within the pump.

To provide that the bearings 6, 7 are always maintained against the side-faces of the gears 10, 11 of the pump channels 12 extend longitudinally across the bearings in order to provide communication between the spaces separating the teeth of the gears 10, 11 with the area of reduced thickness which isolates the other face of the bearings from the covers. Also when considering the flowing direction of the working fluid marked by the arrow F1 of FIG. 2, the inlet and outlet ports 12*a* and 12*b* can also communicate with the space defined between the covers and the journal-bearings.

Each space defined between each bearing and each corresponding cover is delimited by seals in order to correspond to different pressure zones.

Figure 2:
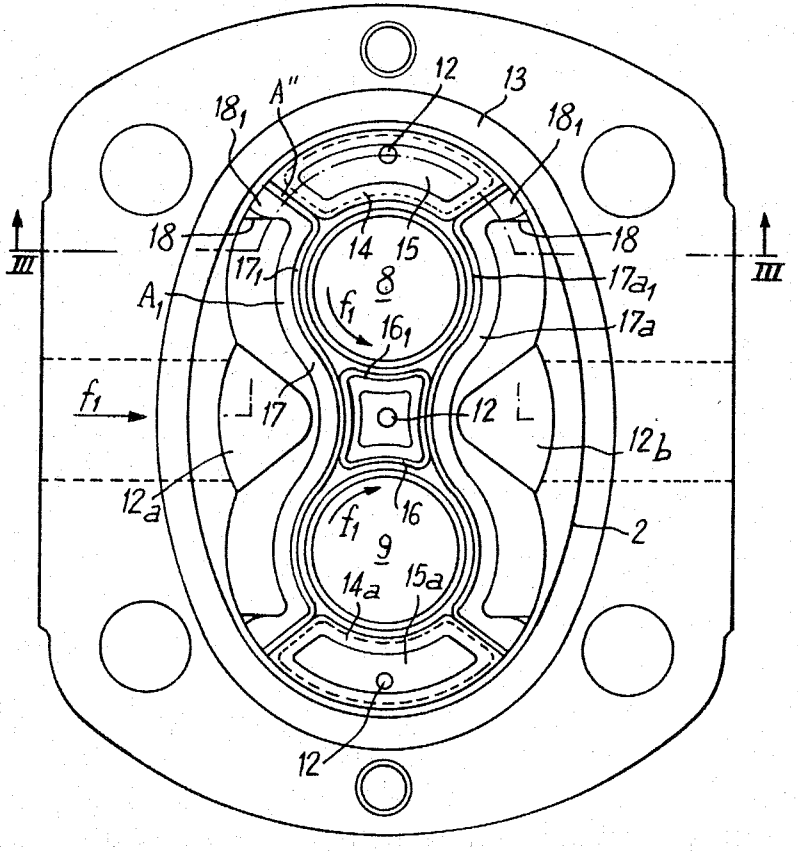
FIG. 2 is a cross-sectional view substantially taken along line II—II of FIG. 1.

FIG. 2 shows an annular seal 13 providing water-tightness between the cover 4 and the housing 1 seals 14, 14*a* for delimiting upper and lower compensation chambers 15, 15*a* respectively, a median seal 16 corresponding to the gearing part of the gears, and two bilateral seals 17, 17*a* which delimit the compensation inlet and outlet zones.

Figure 5:
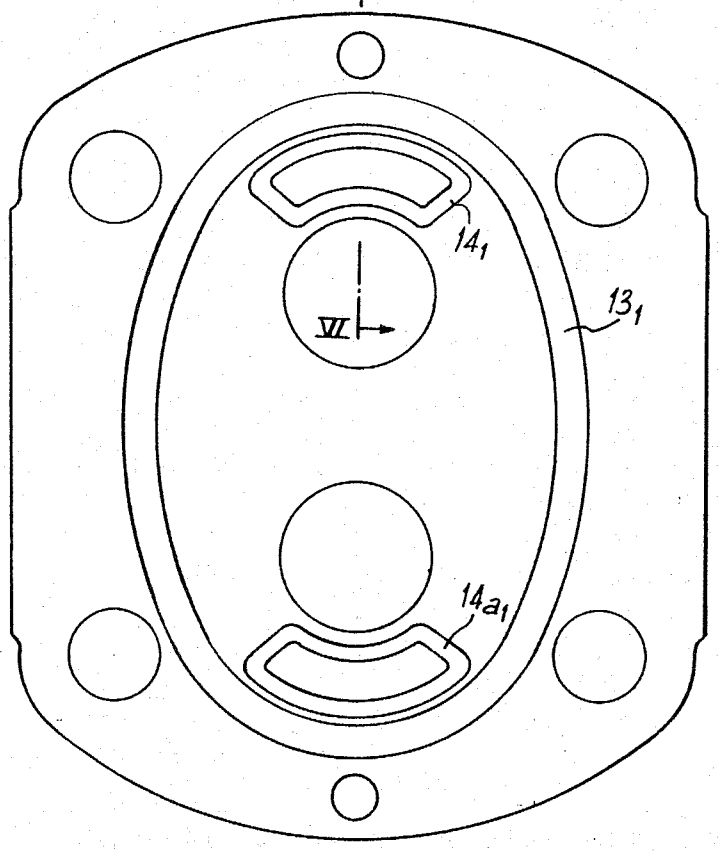
FIG. 5 is an elevational view of one of the covers provided in the pump or motor of FIGS. 1–4.

In the above described embodiment, the annular seal 13 is disposed in a groove $\mathbf{13}_1$ (FIG. 5) provided in each cover; the covers also include grooves $\mathbf{14}_1$, $\mathbf{14}a_1$ for the seals 14, 14*a*.

Grooves $\mathbf{17}_1$ and 17*a* respectively (FIG. 2) are provided in the face of each bearing 6, 7 disposed towards the corresponding cover, one of the edges of the grooves $\mathbf{17}a_1$ being in alignment with edges of the grooves $\mathbf{14}_1$, $\mathbf{14}a_1$ and with edges of the groove $\mathbf{16}_1$ containing the median seal 16.

Figure 4:
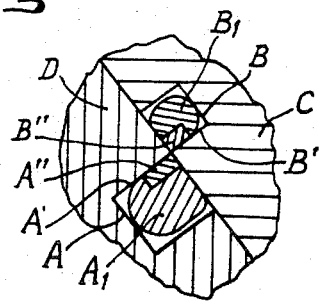
FIG. 4 is an enlarged cross sectional view of of a detail of FIG. 3.
Figure 6:
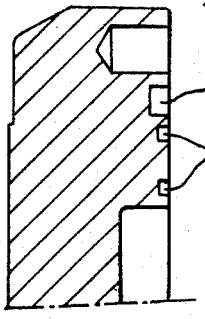
FIG. 6 is a cross-sectional view taken along line VI—VI of FIG. 5.

This arrangement is apparent more particularly in FIG. 4 which shows merely in an illustrative way an arrangement of the different seals, two grooves A and B each containing a seal $A_1$ and respectively $B_1$, these grooves being respectively provided one in a cover C and the other in a bearing D.

FIG. 4 shows that the sides A', B' of the grooves provided in the cover C and the bearing D are rigorously aligned.

FIG. 4 also shows that the grooves can be of a right angular configuration because it is advantageous, according to the invention, that the pressure which operates in the space separating the bearing from the cover operates also within the grooves and consequently tends to urge the seal contained in each groove against the face of the opposite element, that is to say that the seal urged against the bearing is pinched and evenly distorted in the groove of the cover which contains it, and vice-versa. At the sides A' and B' of the grooves, parts of the seals $A_1$ and $B_1$ contain a lateral fitting A'' and B'', respectively, for example of polyamide material when the seals are of elastomeric material. It is important that the above fittings are made of a material harder than that of the seals but with a low coefficient of friction in order that said fittings will not be subjected to an extrusion due to the pressure exerted on the seals.

As it is apparent from the preceding disclosure in operation, differential pressures are developed in a known manner in the different compensation chambers, and these pressures are exerted on the whole surface of the parts of the covers and bearings facing each other without any interruption in the developed compensation forces. Furthermore, because the seals are disposed in complementary grooves provided respectively in the covers and bearings, they are properly maintained without any risk that the developed pressures in the compensation chambers will damage the fragile parts since no wall is provided, and thus insulation between adjacent compensation chambers is only achieved by the seals.

It is further advantageous that the grooves $\mathbf{17}_1$, $\mathbf{17}a_1$ containing the seals 17, 17*a* be widened at their ends as shown at 18 in FIG. 2, and that the elastomeric part $A_1$ should take the shape of a shoulder $\mathbf{18}_1$ in order that the pressure which is exerted in the compensation chambers and in the inlet and outlet chambers always maintains the lateral fitting A'' against the external edge of the groove whereas the shoulder $\mathbf{18}_1$ is itself urged against the internal wall of the cavity 2.

The invention is not limited to the embodiment herein represented and described in detail, since various modifications thereof can be realized without departing from its scope as shown in the appended claims. Particularly, the compensation chambers can be of any shape and number.

What is claimed is:

1. An apparatus for hydrostatic compensation of hydraulic pumps and motors of gear type in which two intermeshing gears are mounted on shafts which are supported by bearings or journal-bearings slidable within a cavity of a pump or a motor housing, said pump or motor housing being closed on both lateral sides by covers, compensation chambers being provided between the bearings and the covers, wherein said chambers are delimited by grooves respectively provided in faces facing the bearings and covers, a part of one side of the grooves provided in the bearings being in alignement with one side of the grooves provided in the corresponding cover, and deformable tightness seals being arranged in said grooves.

2. The apparatus according to claim 1, wherein the grooves are of a right angular configuration so that pressures exerting in compensation chambers delimited by the seals are applied within the grooves on said sides.

3. The apparatus according to claim 1, wherein the side of the seals resting on the aligned side of the grooves is provided with undeformable fittings.

4. The apparatus according to claim 1, wherein one of the grooves opens to the wall of the cavity of the pump or motor housing and has a widening mouth and the seal has a corresponding shoulder.

5. The apparatus according to claim 1, wherein the chambers delimited by the seals placed in the aligned-edge grooves communicate respectively, through channels made across the bearings, with the spaces separating the teeth of the gears and also with inlet and outlet ports.

* * * * *

UNITED STATES PATENT AND TRADEMARK OFFICE

CERTIFICATE OF CORRECTION

PATENT NO. : 4,527,966

DATED : July 9, 1985

INVENTOR(S) : Roger LAUMONT

It is certified that error appears in the above-identified patent and that said Letters Patent is hereby corrected as shown below:

Col. 1, line 50: delete "in";

Col. 2, line 17: delete "of";

line 54: insert a comma --,-- after "pump";

line 67: insert a comma --,-- before "seals";

Col. 4, line 6: delete "should".

Signed and Sealed this

*Twenty-ninth* Day of *October 1985*

[SEAL]

*Attest:*

DONALD J. QUIGG

*Attesting Officer*

*Commissioner of Patents and Trademarks—Designate*